United States Patent [19]

Donan, Jr. et al.

[11] 4,188,158

[45] Feb. 12, 1980

[54] MINE ROOF BOLT HOLE SEAL

[75] Inventors: David C. Donan, Jr.; David M. Donan, both of Manitou, Ky.

[73] Assignee: Waiamea Company, Inc., Manitou, Ky.

[21] Appl. No.: 905,648

[22] Filed: May 15, 1978

[51] Int. Cl.[2] ..... E21D 21/00

[52] U.S. Cl. ..... 405/259; 85/1 JP; 85/50 R; 85/63

[58] Field of Search ..... 61/45 B; 85/63, 50 R, 85/1 JP

[56] References Cited

U.S. PATENT DOCUMENTS

| | | | |
|---|---|---|---|
| 2,829,502 | 4/1958 | Dempsey | 61/45 B |
| 3,300,929 | 1/1967 | Fischer | 85/50 R |
| 3,379,019 | 4/1968 | Williams | 61/45 B |

FOREIGN PATENT DOCUMENTS

| | | | |
|---|---|---|---|
| 84938 | 1/1955 | Norway | 61/45 B |

*Primary Examiner*—David H. Corbin

*Attorney, Agent, or Firm*—Warren D. Flackbert

[57] ABSTRACT

A mine roof bolt hole seal characterized by an arrangement of components which seal the bolt hole from the mine atmosphere at the time the roof bolt is installed and which, thereafter, provides for the removal of moisture and excess oxygen from within the bolt hole, through use of a desiccant and an oxidant. In the preferred invention form, the desiccant and the oxidant are automatically exposed during installation of the roof bolt.

6 Claims, 5 Drawing Figures

MINE ROOF BOLT HOLE SEAL

As is known, the use of roof bolts in a mining operation is quite widespread, such serving to improve the support characteristics of the mine roof strata. Typically, a hole for the roof bolt is drilled upwardly into the mine roof and, subsequently, the roof bolt is anchored in this hole by an expansion shell attached to the free threaded end of the bolt, so that as the bolt is tightened, and the roof bolt base plate moves toward the mine roof, the expansion shell moves outwardly, anchoring the roof bolt in the hole. The preceding installation technique is known to the industry, as is the fact that the bolt hole exposes any vulnerable strata to the mine air.

In this connection, a particular problem arises in the instance of mines with a so-called "tender" roof, such being caused by the deterioration of the mine roof strata due to the interaction of the mine roof strata with moisture and oxygen in the mine air. On one hand, mine strata with a sufficient content of water absorbent clays, such as, for example, montmorillonites and illites, are vulnerable to reaction with a humid mine atmosphere, and, on the other hand, mine roof strata with minerals, such as, for example, pyrite or calcite, react adversely with the oxygen in the mine air and a combination of moisture and oxygen.

The preceding vapor-phased transfer and/or the reaction of the oxygen of the air can cause an ultimate change in the characteristics of the strata, i.e. a weakening mostly in stress bearing characteristics. An exposure to mine air of the aforesaid type may cause the mine roof to fall in the immediately affected areas, the latter creating not only a safety hazard, but an economic burden to the productive operation of the mine.

In addition to the preceding, diurnal biometric pressure changes and pressure variations caused by the pulsations of the fans of the mine ventilation system, as well as changing working areas, cause a variable type of air change within the roof bolt holes in the mine. The preceding is occasioned because roof bolting procedures presently in use do not provide an airtight seal to prevent changes in the air within the roof bolt hole, leaving, as stated, the exposed strata vulnerable to the action of the moisture and oxygen from the mine atmosphere.

The rate of reaction, i.e. water absorption, further depends upon relative humidity and, in this connection, the moisture content of mine air may change from one section of the mine to another and, additionally, the presence of mine water, either in pools or water courses in the mine, also affects the moisture content of the underground air.

The invention overcomes the preceding difficulties and objections by sealing the drilled roof bolt hole from the atmosphere of the remaining mine air. Briefly, the seal of the invention comprises a rubber plug having a passageway therethrough for receiving the shaft of the roof bolt, where the top portion of which, in the form of a cylindrical section, includes a cavity which contains a desiccant and an oxidant. The portion of the seal beneath the cylindrical section defines a truncated cone, where the surface area of which is adapted to snugly fit against any irregularities at the opening of the bolt hole into the roof of the mine. A larger inverted truncated cone portion is disposed at the base of the aforesaid truncated cone portion, such including a flanged area which extends beyond the diameter of the drilled roof bolt hole in order to provide extra sealing surface between the commonly used roof bolt base plate and the roof strata.

A washer type cap, mounted on the roof bolt shaft, extends into the cavity which receives the desiccant and oxidant in a covering relationship. Upon installation, the cap separates from the cavity, permitting the desiccant and oxidant to serve the desired end purposes. In other words, and in the preferred invention form, when the roof bolt hole seal of the invention is installed, sealing and exposure of the desiccant and oxidant are automatically achieved.

In another invention embodiment, a tab-like seal is adhesively secured to the top of the cavity containing the desiccant and oxidant. In this form, however, the seal must be manually removed prior to the installation of the roof bolt. While the same end results are accomplished, the alternative embodiment does depend, in part, upon human error, and, therefore, would not be as reliable, in all instances, as the preferred invention embodiment.

In any event, a better understanding of the present invention will become more apparent from the following description, taken in conjunction with the accompanying drawings, wherein FIG. 1 is a view in side elevation showing the mine roof bolt hole seal of the invention prior to installation, i.e. positioned in the drilled roof bolt hole, but before installation;

Figures 1, 2:
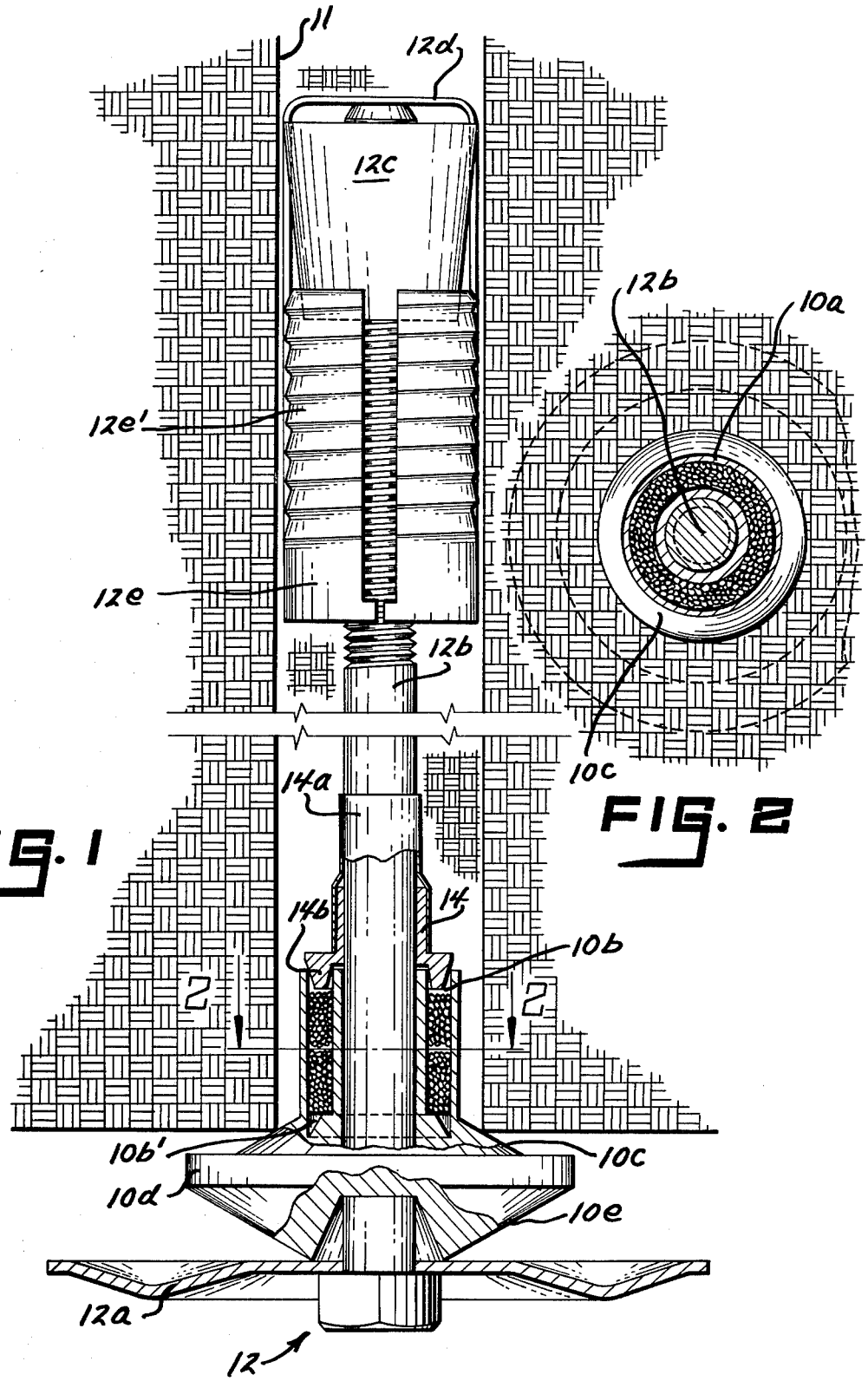
FIG. 2 is a view in horizontal section, taken at line 2—2 on FIG. 1 and looking in the direction of the arrows, showing further details of the invention.

For the purposes of promoting an understanding of the principles of the invention, reference will now be made of the embodiments illustrated in the drawings and specific language will be used to describe the same. It will nevertheless be understood that no limitation of the scope of the invention is thereby intended, such alterations and further modifications of the illustrated devices and such further applications of the principles of the invention as illustrated therein being contemplated as would normally occur to one skilled in the art to which the invention relates.

Figure 3:
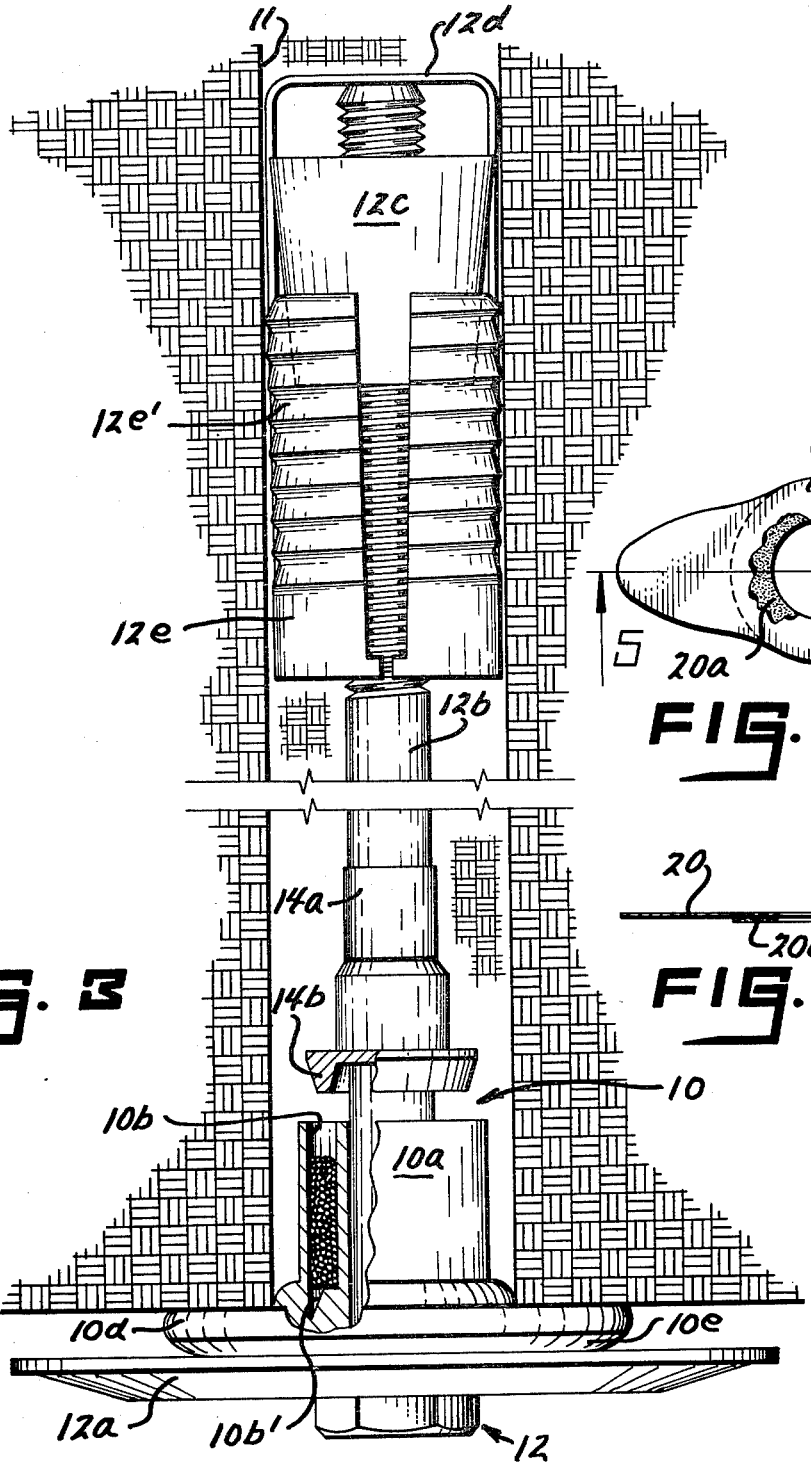
FIG. 3 is another view of the roof bolt hole seal, comparing to that of FIG. 1, but showing such after installation has been achieved.

Referring now to the figures, and particularly to FIGS. 1, 2 and 3, the mine roof bolt hole seal 10 of the invention is shown in connection with a bolt hole 11 drilled into the strata defining the roof of a mining area. The invention includes a known roof bolt 12 extending through a roof bolt base plate **12*a* and having a shaft 12*b* threadedly interconnecting a conical wedge 12*c* positioned by an overlying frame 12*d*. The frame 12*d* mounts an expansion shell 12*e*, the latter having wings 12*e*′ which move outwardly and into gripping relationship with the interior of the bolt hole 11 upon the tightening of the roof bolt 12**. The preceding relationship is known and requires no further discussion herein.

The seal 10 defining the invention includes a body portion **10*a* and a cap 14 which is selectively secured to the roof bolt shaft 12***b*, as by a heat shrinkable collar 14*a*. The body portion 10*a* is disposed around the shaft 12*b* of the roof bolt 12 above the roof bolt base plate 12*a* and beneath the cap 14. As will be apparent from the following discussion, the cap 14 has a downwardly extending portion 14*b* which is in a cooperating and sealing relationship with a cavity 10*b* in the body portion 10*a* of seal 10.

In any event, the body portion 10*a* includes a compression surface 10*c* which is in selective contact with the mine roof, and, more particularly, the area about the opening to the roof bolt hole 11. In other words, the compression surface 10*c*, in the form of a truncated cone, serves for positive sealing purposes upon installation.

A flanged area 10*d* extends outwardly with respect to the aforesaid compression surface 10*c* of the seal beyond the opening to the roof bolt hole 11, serving a further positive sealing function with respect to the installed unit. A pressure ridge portion 10*e*, in the form of an inverted truncated cone, is presented at the bottom of the body portion 10*a* of the seal 10, such, when compressed, affording an airtight seal around the shaft 12*b* of the roof bolt 12. In other words, and as particularly evident in FIG. 3, when the roof bolt base plate 12*a* is fully installed, the compression surface 10*c* intimately engages the space around the roof bolt hole 11, and the roof bolt base plate 12*a* compresses the pressure ridge portion 10*e*, where the overall size of the flanged area 10*d* serves further full sealing purposes.

As stated, a cavity 10*b* is provided for receiving desiccant and oxidant material, such as, for example, a silica gel and iron filings, respectively. A reservoir 10*b*′ is provided beneath the desiccant and oxidant cavity 10*b* to retain water removed by the desiccant from the atmosphere within the roof bolt hole 11. Until installation is completed, it should be noted that the downwardly projecting portion 14*b* of the cap 14 is in a sealed or covering relationship with the desiccant and oxidant cavity 10*b*, and such is particularly evident in FIG. 1.

When used, a roof bolt hole 11 is drilled in the mineral strata, and the assembled seal 10 and cap 14 positioned on the roof bolt 12 and then inserted within the roof bolt hole 11. FIG. 1 illustrates the initial position; thereafter, as the roof bolt 12 is tightened, the relationship of FIG. 3 is achieved, i.e. the cap 14 separates from the covering relationship with the desiccant and oxidant receiving cavity 10*b*. At this time, the latter material can serve the purposes of removing the humidity and oxygen from the roof bolt hole 11. As is evident, the preceding is accomplished automatically, i.e. as the conventional roof bolt is secured in position in the roof bolt hole 11, the cap 14 is removed from its covering relationship with respect to the desiccant and oxidant material receiving cavity 10*b*.

Figure 4:
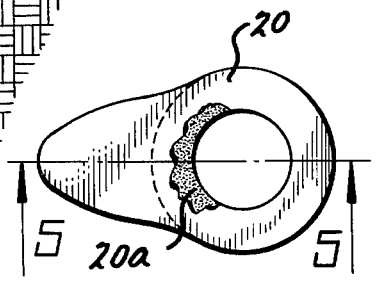
FIG. 4 is a top plan view of an alternative invention form, in this instance, utilizing a hand-pulled closure tab; and, FIG. 5 is a view in vertical section of the closure tab of FIG. 4, taken at line 5—5 of such figure and looking in the direction of the arrows.
Figure 5:
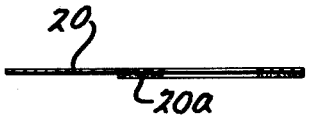

In an alternative invention form, and as evident in FIGS. 4 and 5, a releasable tab-type closure 20 is illustrated, i.e. one which constitutes a substitute for the cap 14, but which requires manual action by the operator during installation. The closure 20 typically includes an adhesive 20*a* on the undersurface thereof, the latter engaging the upper edge of the cavity 10*b* and maintaining a covering relationship with respect to the desiccant and oxidant receiving cavity 10*b*, until physically removed.

While the same end results are achieved with both invention embodiments, the non-automatic function calls for an additional precaution during installation. It should be understood, however, that the configuration of the seal 10 remains the same, i.e. to provide a positive sealing around the opening to the roof bolt hole 11 and the compressing effect resulting from the roof bolt base plate 12*a*.

The invention plays importance in overcoming a problem inherent with a coal mining operation. As evident, a minimum number of added components are necessary to achieve the results of the invention, where such are fabricated from commonly available material. As should be understood, the invention is readily adapted to a conventional roof bolt.

The roof bolt hole seal described hereabove is susceptible to various changes within the spirit of the invention as, for example, in proportioning, in material choice, and, for example, in the manner of securing the cap to the shaft of the roof bolt. Thus, the preceding should be considered illustrative and not as limiting the scope of the following claims.

We claim:

1. In combination with a roof bolt assembly including a roof bolt having a shaft, a roof bolt base plate, and a roof bolt expansion shell in selective engagement with a roof bolt hole drilled in a mine roof, an integral seal surrounding said roof bolt shaft comprising a first portion extending within said roof bolt hole, a second portion extending around the opening to said roof bolt hole in a selective sealing relationship, and a third portion compressed between said roof bolt base plate and said mine roof in an installed position, said first portion having a desiccant receiving cavity therewithin surrounding said roof bolt shaft, and closure means mounted on said shaft of said roof bolt covering said cavity in said first portion and selectively separated from said first portion at said installed position.

2. The combination of claim 1 where said cavity also contains an oxidant.

3. The combination of claim 1 where a reservoir is disposed beneath said cavity in a communicating relationship.

4. The combination of claim 1 where said second portion has a compression surface in the form of a truncated cone bearing against said mine roof.

5. The combination of claim 1 where said third portion is in the form of a truncated cone inverted with respect to said second portion.

6. The combination of claim 1 where a flange disposed between said second portion and said third portion extends laterally beyond said opening to said roof bolt hole.

* * * * *